United States Patent [19]

Kushi

[11] Patent Number: 5,054,451

[45] Date of Patent: Oct. 8, 1991

[54] CONTROL APPARATUS FOR INTERNAL COMBUSTION

[75] Inventor: Naoto Kushi, Toyota, Japan

[73] Assignee: Toyota Jidosha Kabushiki Kaisha, Toyota, Japan

[21] Appl. No.: 586,394

[22] Filed: Sep. 20, 1990

Related U.S. Application Data

[63] Continuation of Ser. No. 328,563, Mar. 24, 1989, abandoned.

[30] Foreign Application Priority Data

Mar. 25, 1988 [JP] Japan ..... 63-71295
Mar. 25, 1988 [JP] Japan ..... 63-71296

[51] Int. Cl.[5] ..... F02M 55/02
[52] U.S. Cl. ..... 123/478; 364/431.05
[58] Field of Search ..... 123/478, 492; 364/431.05, 431.07

[56] References Cited

U.S. PATENT DOCUMENTS

| | | | |
|---|---|---|---|
| 4,370,968 | 2/1983 | Nakatomi | 123/488 |
| 4,424,568 | 1/1984 | Nishimura et al. | 123/492 |
| 4,831,537 | 5/1989 | Scarnora et al. | 364/431.05 |
| 4,836,169 | 6/1989 | Ishikawa et al. | 123/478 |

FOREIGN PATENT DOCUMENTS

| | | | |
|---|---|---|---|
| 62-186033 | 8/1937 | Japan | 123/478 |
| 58-172446 | 10/1983 | Japan | 123/478 |
| 59-201938 | 11/1984 | Japan | 123/478 |
| 60-50241 | 3/1985 | Japan | 123/478 |
| 63-131840 | 6/1988 | Japan | 123/478 |
| 63-131841 | 6/1988 | Japan | 123/478 |

*Primary Examiner*—Raymond A. Nelli
*Attorney, Agent, or Firm*—Cushman, Darby & Cushman

[57] ABSTRACT

A contol apparatus for an internal combustion engine computing basic fuel injection period with an intake pressure and engine speed, computing a correction value from the change rate of the basic fuel injection period, and correcting the basic fuel injection period with the correction value, whereby the fuel injection rate is controlled. In order to prevent an excessive correction with the correction value at the time of rapid acceleration and rapid deceleration, the correction value is computed with the change rate restricted so as not to enlarge or the correction value is computed by multiplying a correction coefficient which is reduced in inverse proportion to the change rate and by the change rate. As a result, an excessive correction can be prevented so that over-rich and over-lean at the time of rapid acceleration and rapid deceleration can be prevented.

22 Claims, 13 Drawing Sheets

CONTROL APPARATUS FOR INTERNAL COMBUSTION

This is a continuation of application Ser. No. 07/328,563, filed on Mar. 24, 1989, which was abandoned upon the filing hereof.

BACKGROUND OF THE INVENTION

1. Field of the Invention

The present invention relates to a control apparatus for an internal combustion engine, and, more particularly, to a control apparatus for an internal combustion engine capable of controlling fuel injection rate and ignition timing on the basis of detected intake pressure.

2. Description of the Related Art

Conventional, internal combustion engines equipped with a control apparatus have been known. The control apparatus computes periodically a basic fuel injection period on the basis of the detected intake pressure and the detected engine speed, obtains a fuel injection period by correcting the basic fuel injection period with intake air temperature and engine cooling water temperature, and opens the fuel injection valves to inject fuel for a period of time equal to the thus-obtained fuel injection period and injects the fuel. In this internal combustion engine, an acceleration fuel increment system is employed in order to improve engine response at the time of acceleration by detecting a change rate in the detected intake pressure and correcting the basic fuel injection period by an amount which is in proportion to the thus-detected change rate.

In the above-described type of internal combustion engine which computes the basic fuel injection period on the basis of the intake pressure, a pressure sensor for sensing the intake pressure (absolute pressure) is attached to an intake pipe, and the basic fuel injection period is computed on the basis of the thus-sensed intake pressure. However, the detected values can be changed due to pulsations of the engine. These changes cause the basic fuel injection period to be changed, and correct control of, fuel inject:,on rate becomes impossible to be performed.

In view of the foregoing, as disclosed in Japanese Patent Application Laid-Open No. 59-201938, the acceleration increment is performed by using two filters which have an individual time constant for weighting the output of the pressure sensor and completely erasing the pulsation component from the output of the pressure sensor, and an overshoot characteristic is given by subtracting the filter output having a relatively large time constant from the filter output having a small time constant. Then the acceleration increment is performed in accordance with the thus-obtained difference between the filter outputs. However, in this known method in which the two filters are used, since the amount of weighting of the output from the pressure sensor is enlarged by using the filter which has a relatively large time constant for the purpose of erasing the pulsation component, the response and resulting capability of the change of output from the filter with respect to the change in the actual change of the intake pressure can deteriorate. As a result, a delay in the acceleration increment attributable to the above will cause a deficiency in the fuel injection at the transient period of the acceleration and generation of a lean spike. Furthermore, in the case of the final stage of the acceleration, a rich spike can be generated due to the overshoot characteristic.

To this end, in order to obtain a detected intake pressure of better response and following characteristics than in using the two filter, it has been recently proposed to process the output from the pressure sensor by using a CR filter which comprises a resistor and a condenser and which has a relatively reduced time constant but is capable of erasing the pulsation component, and to periodically convert the thus-obtained output from the CR filter into a digital value. In this case, since the pulsation component cannot be erased completely by the CR filter, two weighted means, each having individual relaxation or weighting amounts, are computed by using the thus-obtained digital value, that is, a digital filtering is performed, and the second weighted means having a relatively large weighting amount, is subtracted from the first weighted mean having a relatively small weighting amount so that the acceleration increment amount is determined on the basis of the thus-obtained difference.

However, since the weighted means having the large weighting amount is used to obtain the acceleration increment amount in all of the above-described known methods, the response and following characteristics deteriorate. Therefore, there arises a phase delay of the acceleration increment generated in a drive pattern in which acceleration and deceleration are repeated, causing a case that the fuel injection rate does not meet a demand from the engine to increase the fuel. Consequently, a problem arises that the emission and driveability can deteriorate. It might, therefore, be considered feasible to obtain only a small weighting value but capable of erasing the engine pulsation component from the pressure sensor output, and to compute the fuel injection rate including the acceleration increment on the basis of the thus-obtained weighting value. In this method, a certain period of time needs to be taken for the time from computing the fuel injection period to the time at which the injected fuel reaches the combustion chamber this time being attributable to the affect of computing time and the time taken for the fuel to pass through the route. What is worse, a difference is generated between the intake pressure or weighted value used at the time of computing the fuel injection period and an intake pressure corresponding to the actual intake amount. As a result, it is impossible to conduct control with the air-fuel ratio demanded by the engine secured.

This phenomenon will be described in detail with reference to FIG. 4. FIG. 4 is a view which illustrates change in the computed basic fuel injection period TP and intake pressure PM at the time of acceleration of a 4-cylinder 4-cycle internal combustion engine which has a capacity for fuel injection in the suction cycle once in one rotation of the engine by a quantity which is a half of the required quantity. In this case, since the fuel is arranged to be injected once in one rotation of the engine, that is twice in one cycle (referring to this figure, point c and point b), the quantity of fuel contributed to one combustion is, as can be clearly seen from this figure, a quantity corresponding to TPc+TPb. However, the intake pressure representing the actual amount of intake air at the time of combustion is the intake pressure illustrated by symbol a when the suction cycle is completed (at the lower dead center in the suction cycle). As described above, the existence of a time delay tD between the intake pressure at the time of computing the fuel injection period and the intake pressure representing the actual amount of intake air at the time of combustion causes is to be impossible for fuel to be injected in accordance with the actual amount of intake air. As a result, it becomes impossible to conduct control with the air-fuel ratio demanded by the engine secured. On the other hand, it might, therefore, be considered feasible to reduce the time delay tD to the extent which can be neglected by reducing the computing time or the like (if the lower dead center in the suction cycle and the point b coincide with each other). However, in the internal combustion engines which injects fuel once during one engine rotation, fuel is supplied only by a quantity, corresponding to TPc+TPb although the amount of fuel corresponding to 2TPb needs to be supplied during one cycle. As a result, the fuel quantity becomes lessened by an amount obtained by TPb−TPc (=ΔTP) at the time of acceleration.

To this end, the applicant of the present invention has proposed a known method capable of correcting the amount of fuel shortage ΔTP (see Japanese Patent Application No. 61-277019 (Japanese Patent Application Laid-Open No. 63-131840) and Japanese Patent Application No. 61-277020 (Japanese Patent Application Laid Open No. 63-131841).

The principle of these known arts will be described referring to a 4-cylinder 4-cycle internal combustion engine which injects fuel once during one engine rotation.

As described with reference to FIG. 4, neglecting the time delay tD after computing the fuel injection period, the basic, fuel injection period TP corresponding to the actual amount of intake air can be expressed by the following formula (1).

$$TP = TPb + \Delta TP \quad (1)$$

On the other hand, it is assumed that the acceleration is performed at a constant speed as shown in FIG. 5. Since difference ΔTP in the basic fuel injection period between that at the point b and that at the point C and the difference ΔTP' in the basic fuel injection period at the point b and point b' are equal to each other, the basic fuel injection period TPb' at point b' can be expressed by the following formula (2) by using the basic fuel injection period TPb at the point b and the above-described ΔTP (=TP').

$$TPb' = TPb + \Delta TP \quad (2)$$

Assuming that the basic fuel injection period is performed every 360° CA, a basic fuel injection period advanced by 360° CA from the point b is, as will be understood from the formula (2), estimated.

Accordingly, assuming that the calculation of the basic fuel injection period is performed every CY [°CA], and converting the time delay tD between the point a and point b shown in FIG. 4 into a crank angle CAD, the amount of correction corresponding to this crank angle CAD can be derived as follows.

$$\frac{CAD}{CY} \cdot \Delta TP \quad (3)$$

As a result, the basic fuel injection period advanced by the predetermined crank angle CAD from the point b can be estimated. Therefore, considering the correction at the change from the point c to point b, basic fuel injection period TP corresponding to the actual amount of intake air when used at the time of computing the basic fuel injection period every CY [°CA] can be expressed by the following formula (4) using the basic fuel injection period $TP_0$ computed immediately before the lower dead center in the suction cycle.

$$TP = TP_0 + k \cdot \Delta TP \quad (4)$$

where k represents $$\frac{CAD}{CY} + 1,$$

and ΔTP represents the difference obtained by subtracting the basic fuel injection period computed CY [°CA] previously from the present basic fuel injection period $TP_0$. The thus obtained difference becomes a positive value in the case of acceleration, while the same becomes a negative value in the case of deceleration.

In the case where the CR filter is used, the CR filter output can be considered to substantially represent the actual intake pressure attributable to the excellent response of the same with respect to the change in the actual change in the intake pressure. However, weighted mean (corresponding to the weighted value) for computing the basic fuel injection period is delayed, as shown in FIG. 6, behind the actual intake pressure. This delay (control delay tD') can be generated due to the delay in detection by the pressure sensor, the delay in transmitting a signal through the input circuit, the delay in computing timing due to any of the above-described types of delay, the delay in the computing period, and delay caused from weighting the CR filter outputs. Therefore, it is necessary to estimate the fuel injection period by estimating the actual intake pressure PMb taking into consideration the control delay tD' (corresponding to crank angle CAD') from the PMb' for computing the fuel injection rate at Point "b" shown in FIG. 6, computing the basic fuel injection period on the basis of the thus-obtained estimated value and consideration of the above-described time delay tD.

Therefore, including the correction of the control delay tD' (=CAD') in the above-described formula (4), the fuel injection period TP can be expressed as follows.

$$TP = TP_0 + K_1 \cdot \Delta TP \quad (5)$$

$$\text{where } K_1 = \left( \frac{CAD + CAD'}{CY} \right) + 1$$

In a case where the basic fuel injection period TP is calculated from the intake pressure PM and engine speed NE, the formula (5) can be expressed by the following formula (6) by using the difference in the weighting value of the intake pressure (value obtained by subtracting the weighting value for computing the basic fuel injection period by CY°CA earlier from the present weighting value for computing the basic fuel injection period), that is, by using the change rate ΔPM in the weighting value, since TP ∝ PM $$TP = TP_0 + K_1 \cdot \Delta PM \cdot C \quad (6)$$

where C represents a proportional constant for converting the intake pressure into the fuel injection period.

Since the above-described control time delay tD' can be assumed to be substantially constant as to the time periodical phenomenon, it is enlarged in proportion to the engine speed. The crank angle CAD' can be obtained by calculation, and the value $K_1$ at each of the engine speeds can be obtained regardless of the error at the time of manufacturing the engines to be tested. Although the case is described in which the basic fuel injection period is computed at every predetermined crank angle (CY° CA) in the above-described description, the method can be embodied in a case where the basic fuel injection period is computed periodically. In this case, although the correction of CAD' with the engine speed becomes needless, the delay is affected by the engine speed. Therefore, the overall amount of $K_1$ needs to be subjected to correction with the engine speed. In the above description, the case where fuel is injected once during one rotation of the engine is described above. However, in the case of an individual injection system in which each of the cylinders individually injects fuel, the above described time delay tD' causes it to become impossible for fuel to be injected in accordance with the actual amount of intake air. Therefore, it is preferable to estimate the intake pressure (pressure in the vicinity of the lower dead center in the suction cycle) representing the actual amount of intake air at the time of computing the fuel injection period which is advanced by one cycle from computing the present basic fuel injection period. As a result, the method can be embodied in individual injection engines.

However, in the known method in which the basic fuel injection period TP is computed with the formulas (5) and (6), the change rate ΔPM becomes too large a value at a time of rapid acceleration. This leads to the generation of an overshoot of the fuel injection period TAU as shown in FIG. 12 (1), causing the air-fuel ratio to become too rich. As a result CO and HC emissions are increased and driveability is worsened. Furthermore, in the internal combustion engines described above, since the basic ignition advance is obtained from the weighted value of the intake pressure and the engine speed, and the thus obtained basic ignition advance at the time of acceleration is corrected by the change rate ΔPM, the correction of the basic ignition advance with the change rate ΔPM becomes incorrect at a time of rapid acceleration. Furthermore, since the correction with the change rate ΔPM becomes incorrect at the time of rapid deceleration, the fuel injection rate and ignition timing cannot meet the demand of the engine, causing worsened driveability and emission.

SUMMARY OF THE INVENTION

It is an object of the present invention to provide a control apparatus for an internal combustion engine capable of bringing the control factor to a suitable level by correctly performing a correction at the time of rapid acceleration or rapid deceleration when the internal combustion engine is controlled by computing the control factor, such as basic fuel injection period, basic ignition advance and so on, from a weighted value of the intake pressure.

It is another object of the present invention to provide a control apparatus for an internal combustion engine capable of making a control factor a suitable value by properly performing correction over the entire region covering rapid acceleration and rapid deceleration when the internal combustion engine is controlled as described above.

In order to achieve the above-described objects, the first aspect of the present invention lies in a control apparatus, an embodiment of which is shown in FIGS. 2 and 3, comprising: a pressure sensor A for detecting intake pressure; a weighting means B for obtaining a weighting value which weights the change in a signal transmitted from the pressure sensor A; a control factor computing means C for computing a control factor for controlling the engine on the basis of the weighting value; a change rate computing means D for computing a change rate of the weighting value or the control factor; a correction means H for correcting the control factor on the basis of a correction value by performing control to prevent an increase in the correction value which is computed on the basis of the change rate; and a control means G for controlling the engine on the basis of the control factor which has been corrected by the correction means H.

The weighting means B according to the present invention obtains the weighting value by weighting the signal transmitted from the pressure sensor that detects the intake pressure. The weighting value can be obtained from the weighted mean which has been computed previously with the weight of the weighted mean weighted and a present weighted means computed with the present level of the signal transmitted from the pressure sensor A. That is, the weighted means PMNi derived from the following formula (7) can be used as the weighting value.

$$PMNi = \frac{(N-1)\,PMNi_{-1} + PMAD}{N} \tag{7}$$

where PMNi-1 represents a weighted mean which has been previously computed, PMAD represents the present level of the signal transmitted from the pressure sensor and N is a coefficient related to the weighting. The same can employ a value obtained by directly converting the output transmitted from the pressure sensor into a digital value or a value obtained by converting the output from the pressure sensor which has been processed by the CR filter into a digital value. Such a weighted mean can be obtained through a digital filtering treatment.

The control factor computing means C computes the control factor for controlling the engine on the basis of the weighting value. The control factor can be exemplified through a basic fuel injection period and a basic ignition advance. This control factor computing means C controls at least one of the basic fuel injection periods and the basic ignition advance. The change rate computing means D computes the change rate of the weighting value or the change rate of the control factor. The correction means H corrects the control factor by restricting the correction value determined on the basis of the change rate. The control means G controls the engine on the basis of the thus-corrected control factor. Since the correction is, as described above, so performed the correction value is not enlarged and the control factor can be prevented from being excessively enlarged.

As described above, since the control is performed so that the control factor cannot be enlarged excessively, the excessive correction attributable to the change rate at the time of rapid acceleration and rapid deceleration can be prevented. As a result, emission and driveability can be improved.

The second aspect of the present invention lies in, as shown in FIG. 2, a control apparatus comprising: a restriction means E for restricting the correction means H in such a manner that the change rate does not exceed a predetermined level; and a control factor correction means F for correcting the control factor on the basis of the change rate which has been restricted by the restriction means E. The restriction means E restricts the change rate which has been computed by the change rate computing means D in such a manner that the same does not exceed the predetermined level. The control factor correction means F corrects the control factor which has been computed by the control factor computing means C on the basis of the change rate restricted as described above. The control means G controls the engine on the basis of the thus-corrected control factor. Since the restriction is performed so that the change rate does not exceed the predetermined level, and thereby the correction value is restricted from being enlarged, an excessive correction can be prevented and thus the correction can be performed correctly.

With the restriction means, excessive correction at the time of rapid acceleration can be prevented attributable to the control being performed in such a manner that the change rate does not exceed a predetermined positive level at the time of rapid acceleration. Another type of excessive correction at the time of rapid deceleration can be prevented attributable to the control being performed in such a manner that the change rate does not exceed a predetermined negative level (does not become below the predetermined negative level). In addition, an excessive correction at the time of rapid deceleration can be prevented by performing a restriction in such a manner that the absolute value of the change rate does not exceed a predetermined level.

As described above and according to the present invention, since the change rate of the weighting value and the change rate of the control factor are restricted not the exceed the corresponding predetermined levels, excessive correction at the time of rapid acceleration and rapid deceleration can be prevented. As a result, an effect can be obtained where emission and driveability can be improved.

The third aspect of the present invention lies in a control apparatus comprising: a coefficient setting means I for setting a correction coefficient which is inverse to the absolute value of the change rate; and a control factor correction means J for correcting the control factor on the basis of a produce of the change rate and the correction coefficient.

The coefficient setting means I determines the correction coefficient which is inverse to the absolute value of the change rate. The correction means J corrects the control factor which has been computed by the control factor computing means C on the basis of the product of the change rate and the correction coefficient. The control means G controls the engine on the basis of the thus-corrected control factor. Since the correction coefficient is, as described above, arranged to be reduced inverse to the absolute value of the change rate, the correction value can be reduced as much as possible at the time of rapid acceleration or deceleration in which the absolute value of the change rate is enlarged. Therefore, the response of excessive correction can be sufficiently maintained in the region in which the absolute value of the change rate is reduced at the transient period of acceleration or deceleration. In addition, the correction value can be continuously reduced from the intermediate period of the acceleration of deceleration to the final period of the same through which the absolute value of the change rate is enlarged so that overshoot can be significantly reduced. In addition overshoot in the acceleration and the deceleration regions in which the absolute value of the change rate is relatively small can be significantly reduced since the correction coefficient become small in inverse proportion to the absolute value of the change rate from the transient period of acceleration and deceleration to the intermediate period of the same.

As described above, according to the present invention, since the control factor is corrected by using the correction coefficient which can be reduced in inverse proportion to the absolute value of the change rate, overshooting can be reduced over a region from rapid acceleration and deceleration to moderate acceleration and deceleration with the transient response to excessive correction secured. As a result, the effects of improvement in emission and driveability can be obtained.

BRIEF DESCRIPTION OF THE DRAWINGS

FIG. 18 (A), (B), and (C) are diagrams which illustrate change in the amount of increment and air-fuel ratio and so on.

DESCRIPTION OF THE PREFERRED EMBODIMENTS

Figure 7:
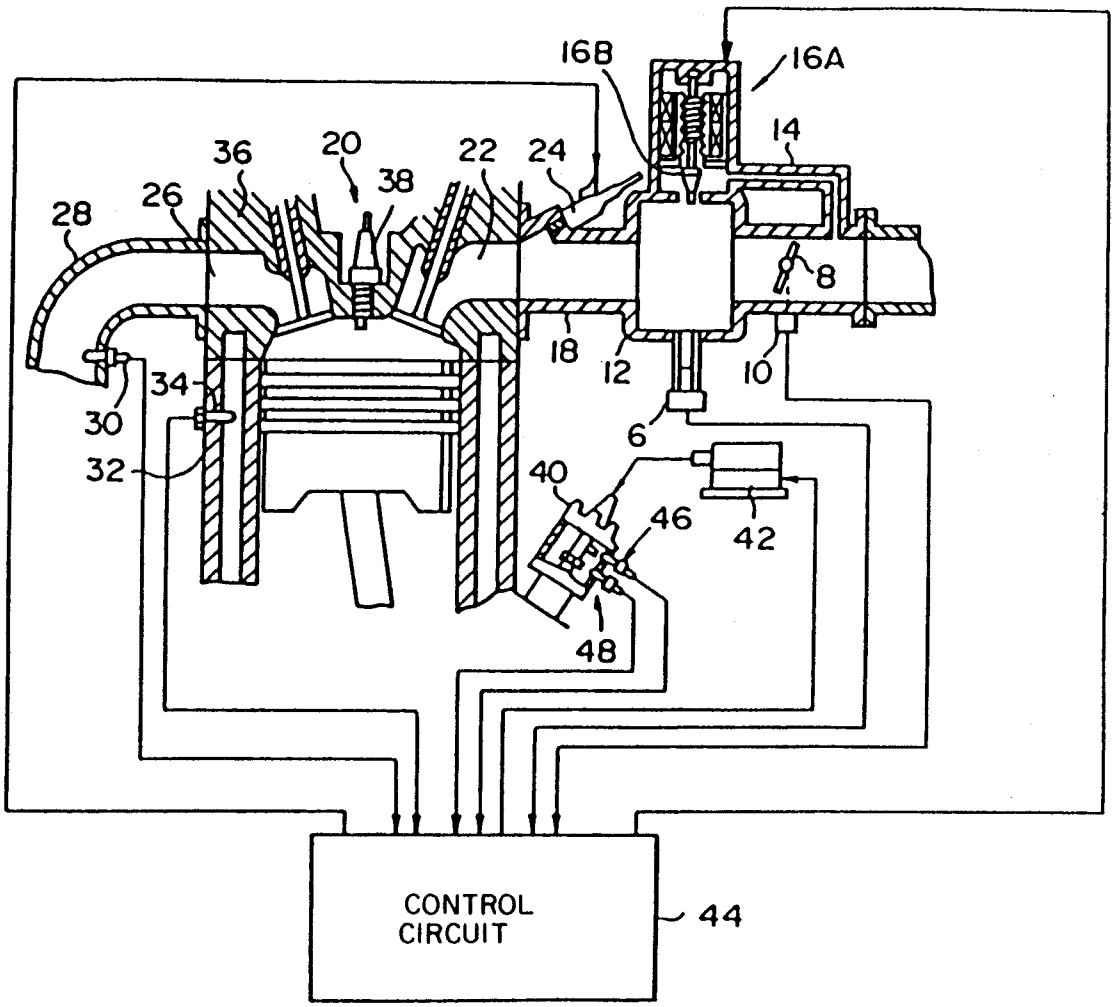
FIG. 7 is a schematic view which illustrates an engine provided with a fuel injection rate control apparatus in which the present invention can be embodied.

An embodiment of the present invention will be described in detail with reference to the drawings. In the description given hereinafter, a case in which a fuel injection period is used as a control factor will be described in principle. FIG. 7 illustrates schematically an internal combustion engine provided with a fuel injection rate control apparatus in which the present invention can be embodied.

This engine is arranged to be controlled by an electronic control circuit such as a microcomputer. Down stream from an air cleaner (omitted from illustration), a throttle value 8 is disposed. A linear throttle sensor 10 which transmits a voltage corresponding to the throttle opening degree, is attached to this throttle valve 8, and a surge tank 12 is provided down stream from the throttle valve 8. A semiconductor type pressure sensor 6 is attached to the surge tank 12. The pressure sensor 6 is connected to a filter 7 (see FIG. 8) comprising a CR filter having a small time constant (for example 3 to 5 msec) and exhibiting an excellent response for erasing a pulsation component from intake pressure. The filter may be included within the pressure sensor. Furthermore, a bypass 14 is disposed in such a manner that it bypasses the throttle valve 8 and communicates up stream from the throttle valve 8 and the surge tank 12 which is disposed down stream from the throttle valve 8. An ISC (Idle Speed Control) valve 16B is disposed within this bypass 14. The degree of opening of this ISC valve 16B is adjusted by a pulse motor 16A which includes a 4-pole stator. The surge tank 12 is connected to a combustion chamber of an engine 20 via an intake manifold 18 and an intake port 22. A fuel injection valve 24 is respectively attached to the cylinders in such a manner that these injections valves 24 project into a space within the intake manifold 18.

The combustion chamber of the engine 20 is connected to a catalyser device (omitted from illustration) filled with a catalytic converter rhodium via an exhaust port 26 and an exhaust manifold 28. An $O_2$ sensor for transmitting a signal which is inverted at a theoretical air fuel ratio is attached to this exhaust manifold 28. A cooling water temperature sensor 34 is attached to an engine block 32 in such a manner that the cooling water temperature sensor 34 penetrates the engine block 32 and projects into a space within a water jacket. This cooling water temperature sensor 34 transmits a water temperature signal by detecting the temperature of the engine cooling water which represents the engine temperature. The engine temperature may be represented by the detected engine oil temperature.

An ignition plug 38 is respectively attached to the cylinders in such a manner that the ignition plug 38 penetrates a cylinder head 36 and projects into the combustion chamber. These ignition plugs 38 are connected to an electronic control circuit comprising a microcomputer via a distributor 40 and an igniter 42. A cylinder determining sensor 46 and a rotation angle sensor 48, each of which is composed of a signal rotor secured to a distributor shaft and a pickup secured to a distributor housing, are attached within the distributor 40. The cylinder determining sensor 46 transmits a cylinder determination signal, for example, every 720° CA, while the rotation angle sensor 48 transmits an engine speed signal, for example, every 30° CA.

Figure 8:
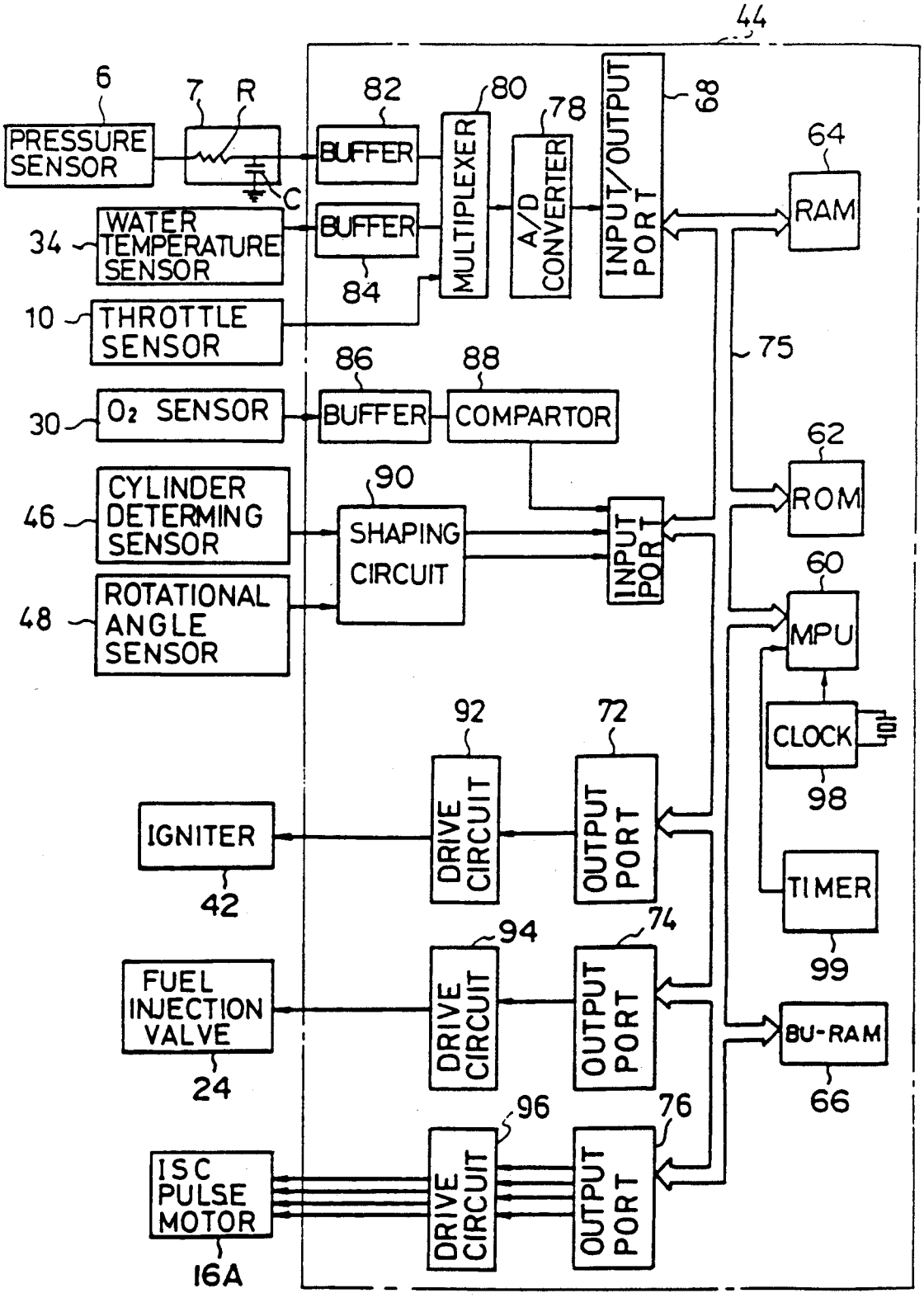
FIG. 8 is a block diagram which illustrates a control circuit shown in FIG. 7 in detail.

As shown in FIG. 8, the electronic control circuit 44 comprises: a microprocessing unit (MPU) 60, a read only memory (ROM) 62, a random access memory (RAM) 64, a backup RAM (BU-RAM) 66, an input-/output port 68, an input port 70, output ports 72, 74, and 76, and a data bus and control bus 75 connecting the above described components. An analog to digital (A/D) converter 78 and a multiplexer 80 are connected to the input/output port 68 in the sequential order of this description. The pressure sensor 6 is connected to the multiplexer 80 via the CR filter 7 composed of a resistor R, a condenser C, and a buffer 82, and the cooling water temperature sensor 34 is also connected to the same via a buffer 84. The linear throttle sensor 10 is connected to the multiplexer 84. The MPU 60 controls the multiplexer 80 and the A/D converter 78, and successively converts the output from the pressure sensor 6, the output from the linear throttle sensor 10 and that from the cooling water temperature sensor 34 inputted through the CR filter 7 into digital signals, and has the thus-obtained digital signals stored in the RAM 64. Therefore, the multiplexer 80, the A/D converter 78 and the MPU 60 serve as sampling means for periodically sampling the output from the pressure sensor. The $O_2$ sensor 30 is, via a comparator 88 and a buffer 86, connected to the input port 70. The cylinder determining sensor 46 and the rotational angle sensor 48 are also connected to the input port 70 via the wave shaping circuit 90. The output port 72 is connected to the igniter 42 via a drive circuit 92. The output port 74 is connected to the fuel injection valve 24 via a drive circuit 94 provided with a down-counter. The output port 76 is connected to the pulse motor 16A of the ISC valve via a drive circuit 96. Reference numeral 98 represents a clock, and 99 represents a timer. The above-described ROM 62 previously stores a program for a control routine which will be described hereinafter.

A control routine according to the present invention will be described in the case where the present invention is embodied in the above-described engine and a weighting value is detected with a weighted mean obtained by calculation. Although the values which do not obstruct the thesis of the present invention are used in the description given hereinafter, the present invention is not limited to these values.

Figure 9:
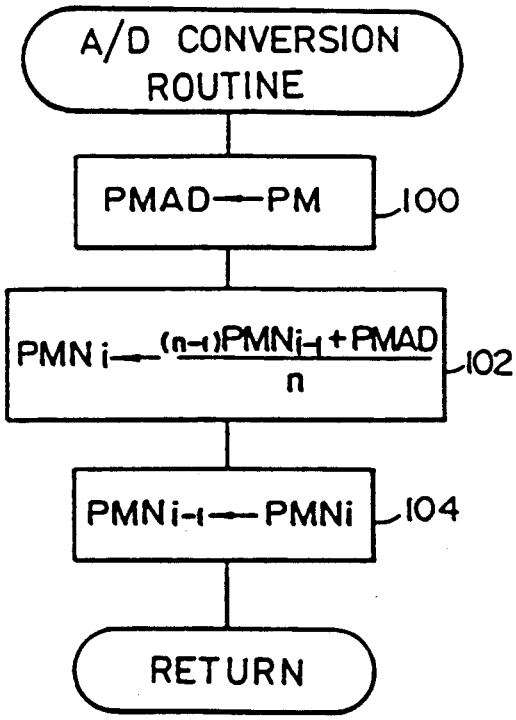
FIG. 9 is a flow chart which illustrates an A/D converting routine according to the first and second embodiments.

FIG. 9 illustrates an A/D converting routine executed every 4 msec. In step 100, a signal transmitted from the pressure sensor 6 is supplied to the A/D converter 78 via the CR filter 7, buffer 82 and the multiplexer 80. The intake pressure PM which has been digitally converted by the A/D converter 78 is taken in as digital value PMAD. In the next step 102, a weighted means PMNi of the present intake pressure is computed in accordance with the formula (7) by using the digital value PMAD of the intake pressure and the weighted mean $PMNi\text{-}_1$ of the intake pressure computed previously by 4 msec, arranging the weight coefficient N (for example 4) of the formula (7) to be n. In step 104, in order to compute the next weighted mean of the intake pressure, the weighted mean PMNi of the present intake pressure is stored in the 4 ms register as the weighted mean $PMNi\text{-}_1$ of the previous intake pressure.

Figure 1:
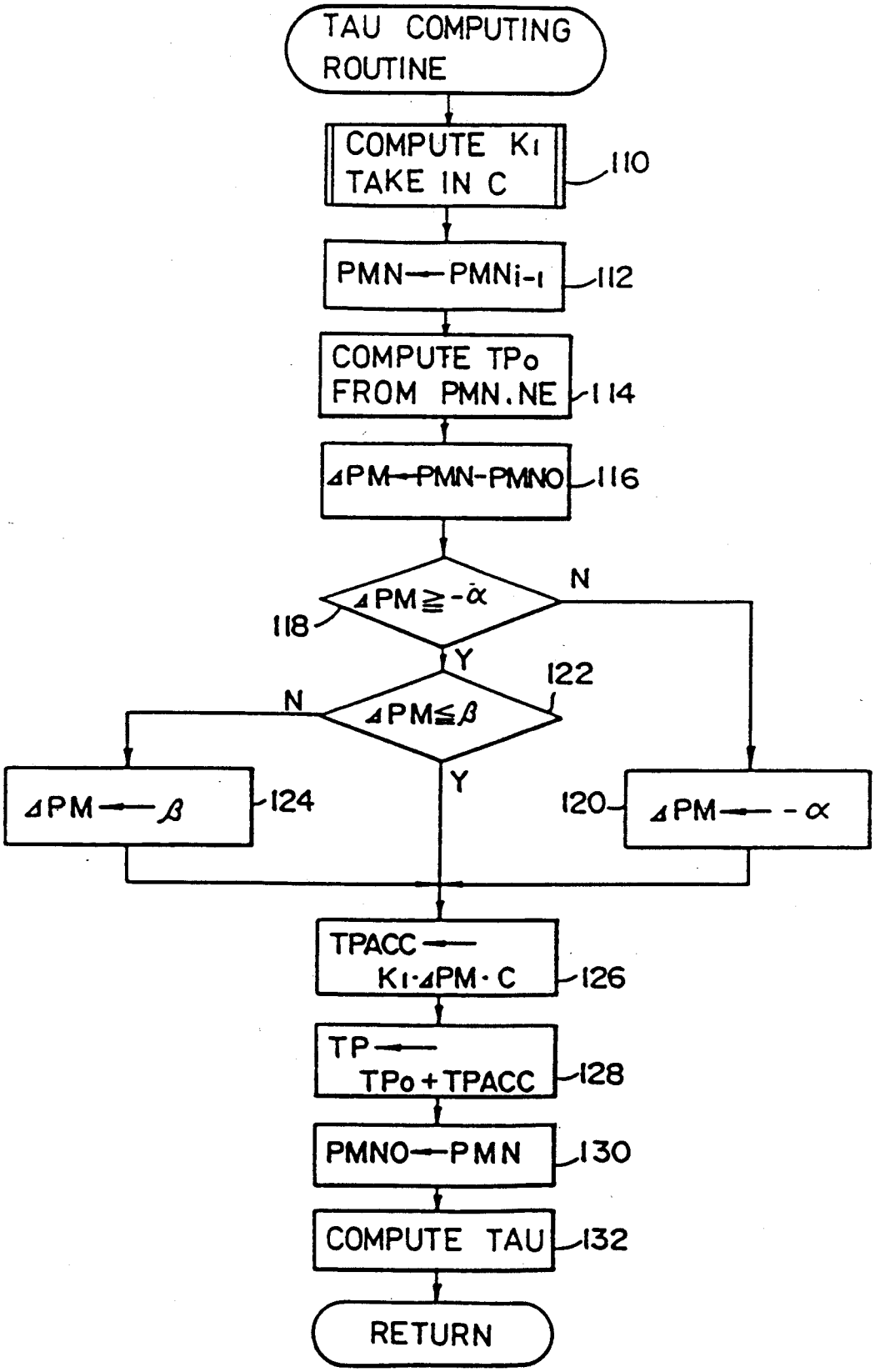
FIG. 1 is a flow chart which illustrates a first embodiment of a routine for computing a fuel injection period according to the present invention.
Figure 2:
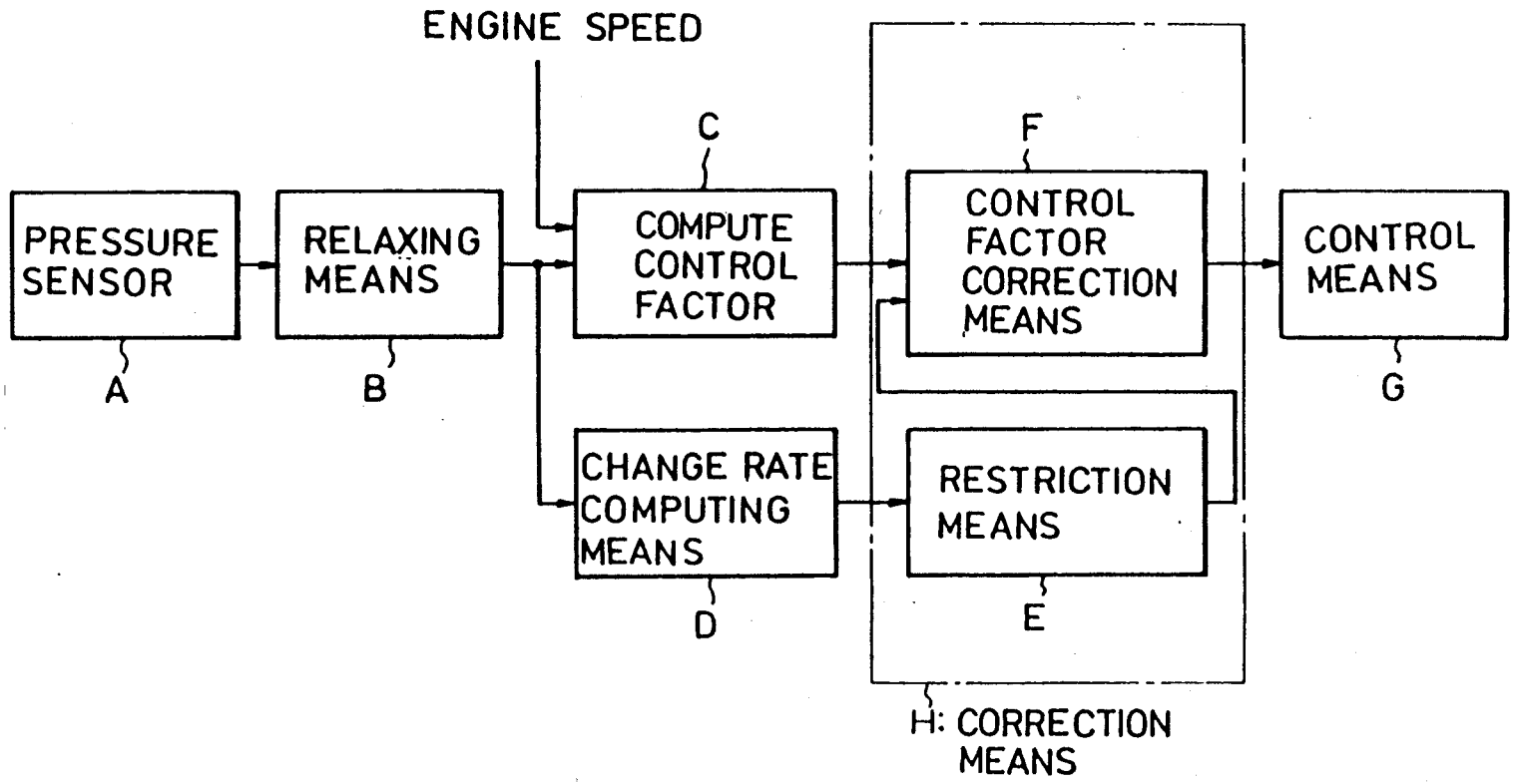
FIG. 2 is a block diagram which illustrates the first embodiment and a second embodiment.
Figure 3:
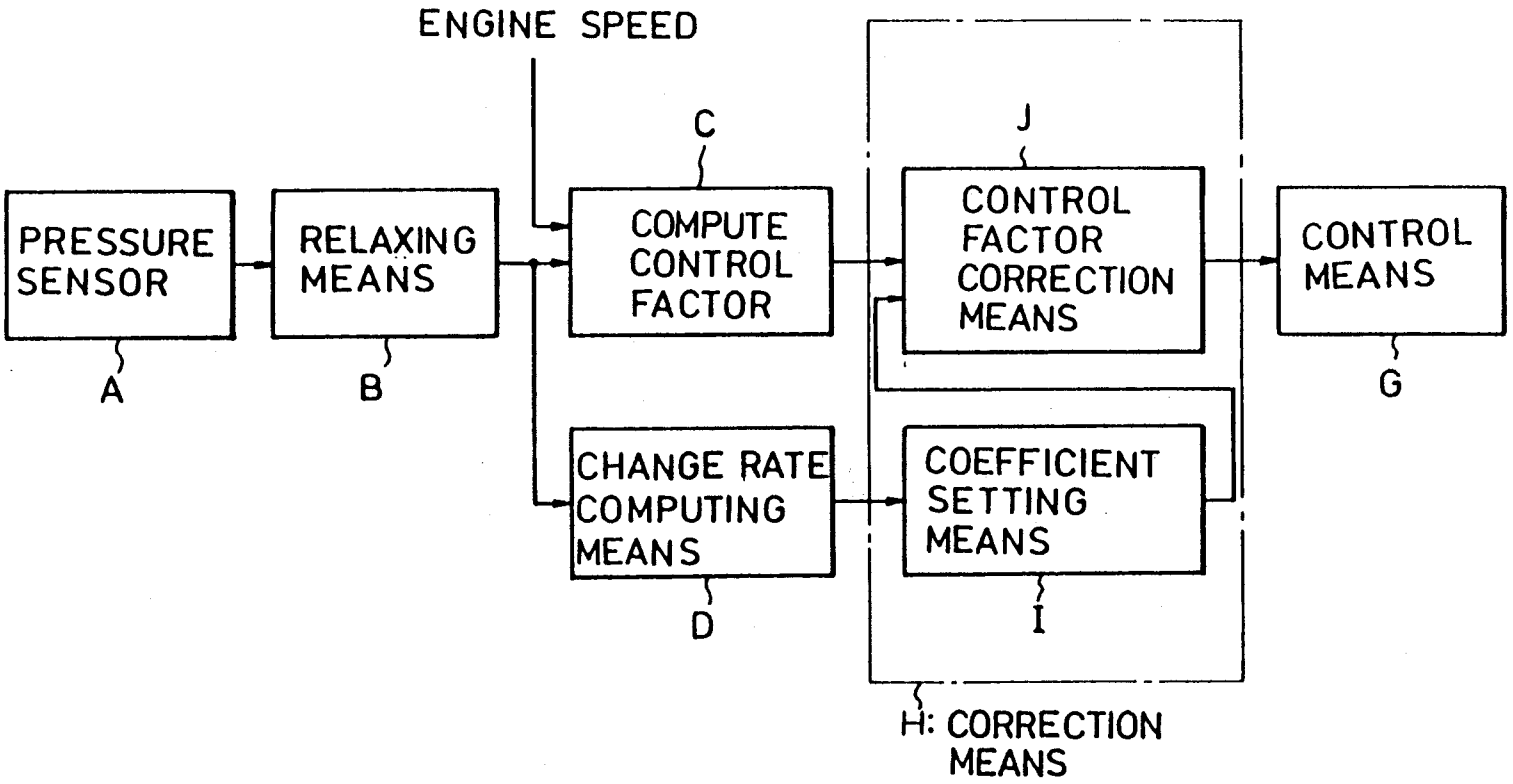
FIG. 3 is a block diagram which illustrates the first and a third embodiment.
Figure 4:
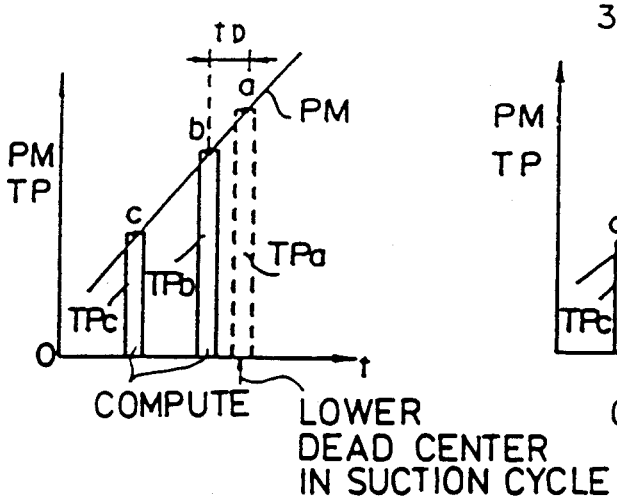
FIG. 4 is a diagram which illustrates the delay of the fuel injection rate when fuel is injected once during one rotation of the engine.
Figure 5:
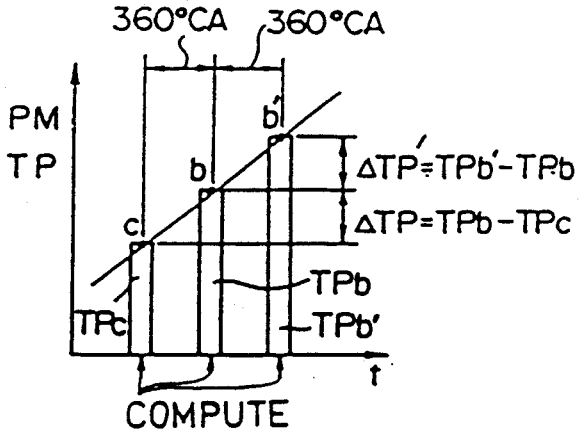
FIG. 5 is a diagram which illustrates change in intake pressure and a basic fuel injection period in a state of constant acceleration.
Figure 6:
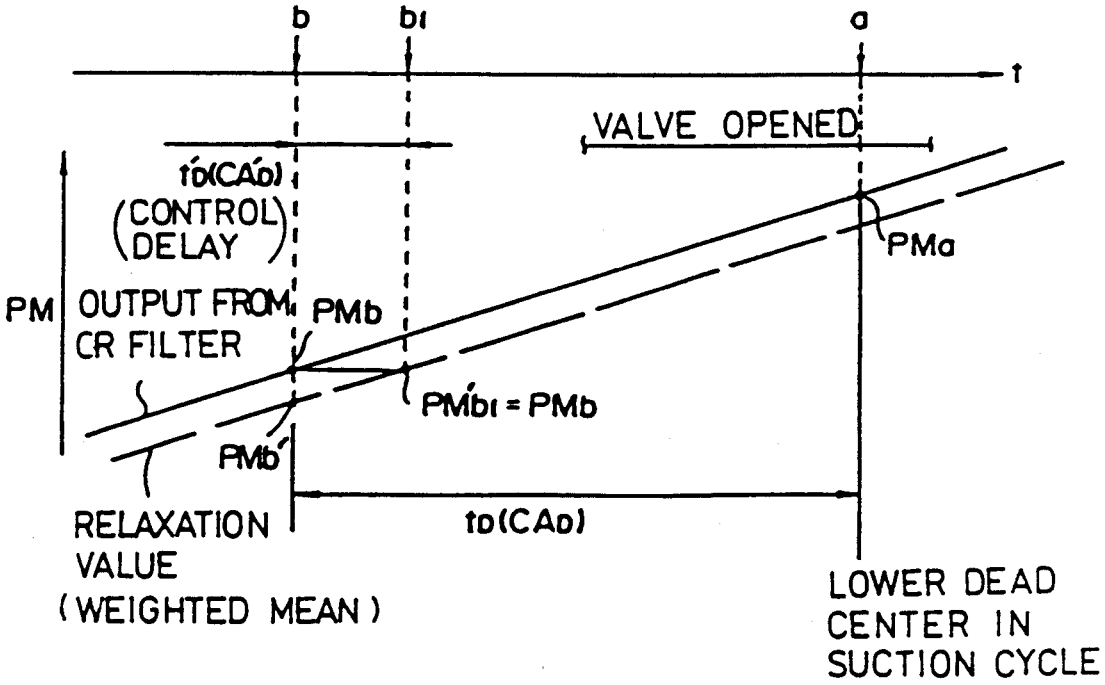
FIG. 6 is a diagram which illustrates the compensation of fuel attributable to a delay of control.
Figure 10:
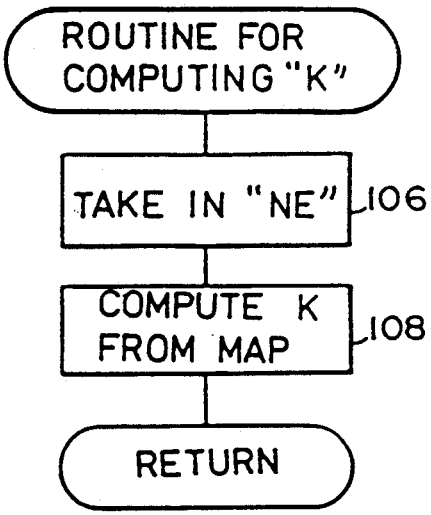
FIG. 10 is a flow chart which illustrates a computing routine for coefficient $K_1$ according to the first and second embodiments.
Figure 11:
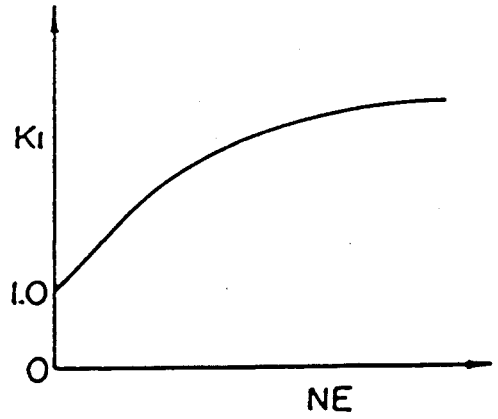
FIG. 11 is a diagram which illustrates a map for correction coefficient $K_1$.

FIG. 1 illustrates a routine for computing a fuel injection period which is carried out at every fuel injection period computing timing (in a 4-cylinder 4-cycle engine it is every 360° CA). In step 110, coefficient $K_1$ is computed and also coefficient C is taken in. This coefficient $K_1$ is obtained as shown in FIG. 10 by taking engine speed NE in step 106 and computing the coefficient $K_1$ corresponding to the present engine speed NE from the map shown in FIG. 11 in step 108. The coefficient $K_1$ is stored in the ROM in the form of a map obtained by a calculation. This coefficient $K_1$ is expressed by an increasing function, increasing from 1.0 in accordance with a rise in the engine speed NE as shown in FIG. 11. In this case, the coefficient C may be either a constant or a variable.

In the next step 112, the weighted mean of the present intake pressure is taken in as PMN. Since the weighted mean PMNi of the present intake pressure is stored in the register as $PMNi_{-1}$ in step 104 shown in FIG. 9, the weighted mean of the present intake pressure can be taken in as PMN by reading the value of this register. In the next step 114, the present basic fuel injection period $TP_0$ is computed conventionally by using the weighted mean PMN of the present intake pressure which has been taken in step 112 and the engine speed NE. In the next step 116, the change rate ΔPM of the weighted mean of the intake pressure is computed by subtracting the weighted mean PMNO of the previous intake pressure used for computing the previous basic fuel injection period CA 360° CA from the weighted means PMN of the present intake pressure. In the next step 118, it is determined whether the change rate ΔPM exceeds a predetermined negative value $-\alpha$ (for example $-50$ mmHg/rotation) or not. If $\Delta PM < -\alpha$, it is determined that the present state is in a rapid deceleration state and, in step 120, the value of the ΔPM is made $-\alpha$ for the purpose of preventing the change rate ΔPM from becoming less than $-\alpha$. On the other hand, in step 122, with $\Delta PM \geqq -\alpha$, it is determined whether the change rate ΔPM is below a positive predetermined value $\beta$ (for example 50 mmHg, one rotation) or not. If $\Delta PM > \leftarrow\beta$, it is determined that the state is in a rapid acceleration state, and in step 124, the change rate ΔPM is made $\beta$ in order to prevent ΔPM from exceeding $\beta$.

Next, in step 126, the coefficient $K_1$ is computed in step 108, the change rate ΔPM of the weighted means of the intake pressure computed in step 116, and the coefficient C for converting the intake pressure into the fuel injection period are multiplied so as to compute the increment TPACC {which corresponds to the second term on right side of the formula (6)}. In step 128, by adding the increment TPACC to the present basic fuel injection period $TP_0$, the present basic fuel injection period $TP_0$ is corrected. Then, in step 130, the weighted mean PMN of the present intake pressure is stored in the register in place of the weighted mean PMNO of the intake pressure which was the pressure 360° CA previously. In step 132, the basic fuel injection period TP is corrected by intake air temperature and engine cooling water temperature so as to compute the fuel injection period TAU. As a result, fuel is injected once during a rotation of the engine in a fuel injection rate controlling routine (omitted from illustration).

Figure 12A:
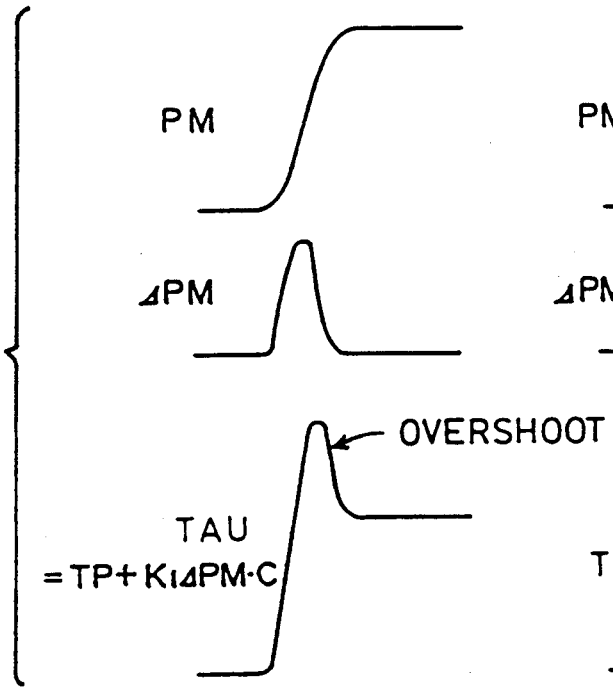
FIGS. 12 (A) and (B) are diagrams which illustrate change in a fuel injection period according to a conventional example and the first embodiment.
Figure 12B:
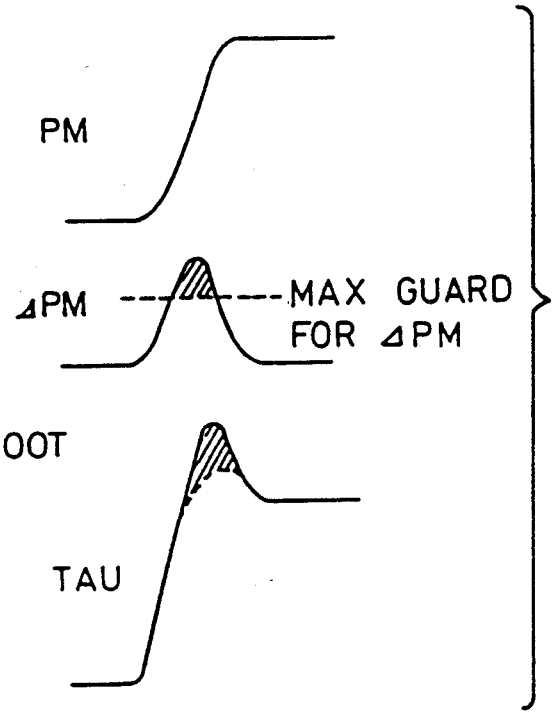

In the above-described step 132, the basic fuel injection period TP used for computing the fuel injection period TAU is corrected in accordance with the formula (6) described in step 128 and delay attributable to the control delay can be prevented. As a result, since the corrected value corresponding to the actual air intake amount can be obtained, a change in the air-fuel ratio at the time of mode change is prevented. Since the change rate of the weighted mean of the intake pressure is restricted in step 120 or step 124, the excessive correction at the time of rapid acceleration and deceleration can be prevented. The change in the fuel injection time TAU becomes as illustrated in FIG. 12 (2) and the overshoot corresponding to hatching is prevented. Alternatively to ΔPM, ΔTP may be employed to compute the fuel injection period TAU on the basis of the formula (5).

Next, a second embodiment of the present invention will be described. Similar to the first embodiment, if control is performed with ΔTP or ΔPM·C in order to make the correction amount $K_1 \cdot \Delta TP$ (or $K_1 \cdot \Delta PM \cdot C$) a suitable value in a rapid change state, the overshoot can be rapidly reduced in the regions in which these values exceed the upper or lower limits $\beta$ and $-\alpha$. However, the above-described overshoot can be generated in the regions which do not reach the upper limit, causing driveability and emission to deteriorate.

To this end, the second embodiment is arranged to be capable of performing a proper correction over the entire region of rapid acceleration and rapid deceleration.

A control routine according to the second embodiment in the case where the present invention is embodied in the above-described engine and the weighted value is detected by the weighted mean obtained by a calculation, will be described with reference to FIG. 13.

Figure 13:
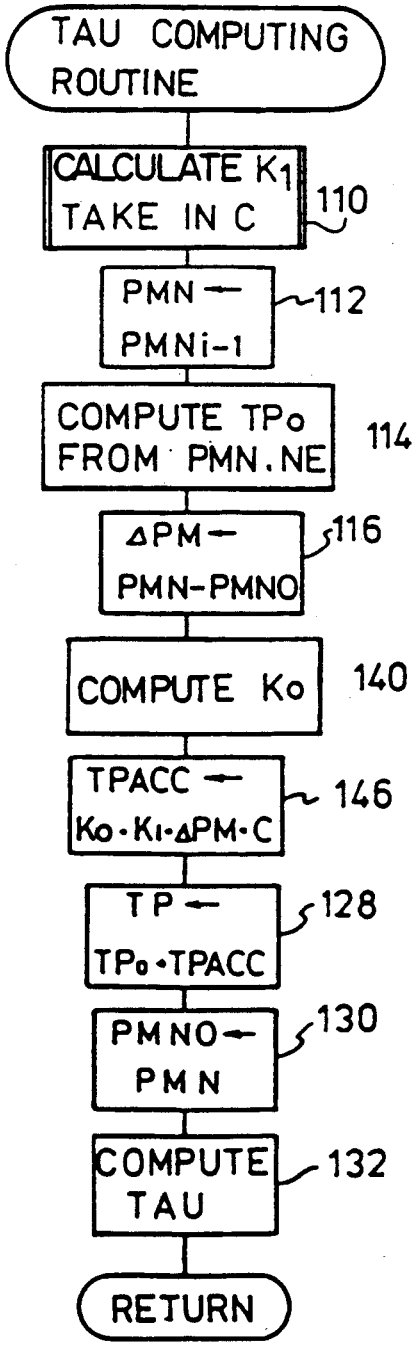
FIG. 13 is a flow chart which illustrates a routine for computing a fuel injection period according to the second embodiment.

The components shown in FIG. 13 and corresponding to those in FIG. 1 are given the same reference numerals and the description is omitted.

Since a routine for computing the weighted mean PMNi is the same as that shown in FIG. 9 and a routine for computing the coefficient $K_1$ is the same as that shown in FIG. 10, the descriptions are omitted.

Figure 14:
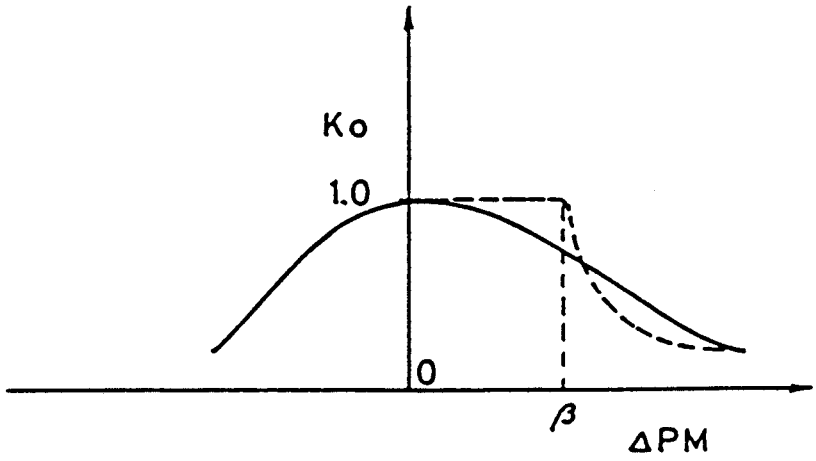
FIG. 14 is a diagram which illustrates a map for correction coefficient $K_0$.

In step 116, the change rate ΔPM of the weighted mean of the intake pressure is computed, then, in step 140, correction coefficient $K_0$ corresponding to the present change rate ΔPM is computed from the map for the correction coefficient $K_0$ represented by the function of the change rate ΔPM shown in FIG. 14. This correction coefficient $K_0$ is arranged to become smaller in the region $\Delta PM \geqq 0$ in inverse proportion to the ΔPM, while becoming smaller in the region $\Delta PM < 0$ in proportion to ΔPM, it being, as a whole, arranged to be reduced in inverse proportion to $|\{PM|$. The curve which indicates the correction coefficient $K_0$ is asymmetric with respect to the axis of the ordinate, and the change ratio of the correction coefficient $K_0$ in the region $\Delta PM < 0$ is arranged to be larger than that in the region $\Delta PM \geqq 0$. The reason for this lies in that an engine pumping action shown generally at the time of deceleration causes a relatively larger change in the intake pressure than for the intake pressure at the time acceleration. Therefore, the change in the correction coefficient $K_0$ is larger in the region $\Delta PM < 0$ than in the region $\Delta PM \geqq 0$. The correction coefficient is determined properly in accordance with the types of the engines, and it may be determined as to become symmetrical with respect to the axis of ordinate. The dashed line in FIG. 14 represents the change in the correction coefficient $K_0$ equal to the case where the limitation $\Delta PM = \beta$ is realized when $\Delta PM > 0$ (for example, 50 mmHg/rotation). As can be clearly seen from this figure, the correction coefficient can be smoothly reduced according to this embodiment and the overshooting can be suitably reduced in any acceleration and deceleration cases. In addition, since the correction coefficient is retained in the form of the map, an enlarged freedom upon the application can be obtained.

In the next step 146, the coefficient $K_1$ computed in step 108, correction coefficient $K_0$ computed in step 140, change rate ΔPM of the weighted mean of the intake pressure computed in step 116, and coefficient C for converting the intake pressure into the basic fuel injection period are multiplied so as to compute the increment TPACC. As a result, as described in the first embodiment, fuel is injected once during a rotation of the engine in accordance with the fuel injection rate control routine (omitted from the illustration).

Figure 15A:
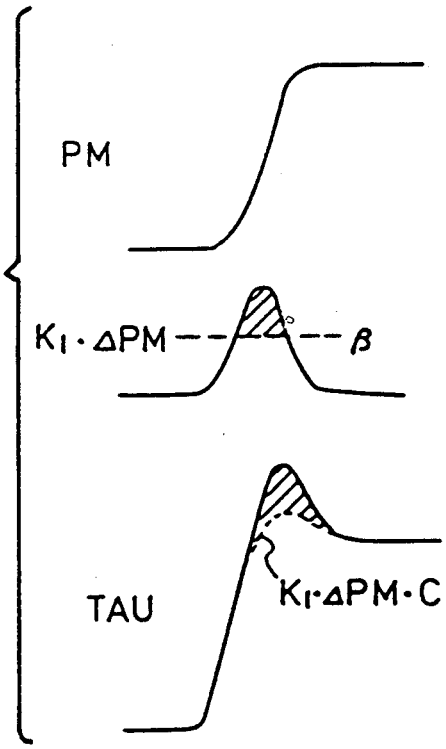
FIGS. 15 (A) and (B) are diagrams which illustrate change in a fuel injection period according to the first and second embodiments.
Figure 15B:
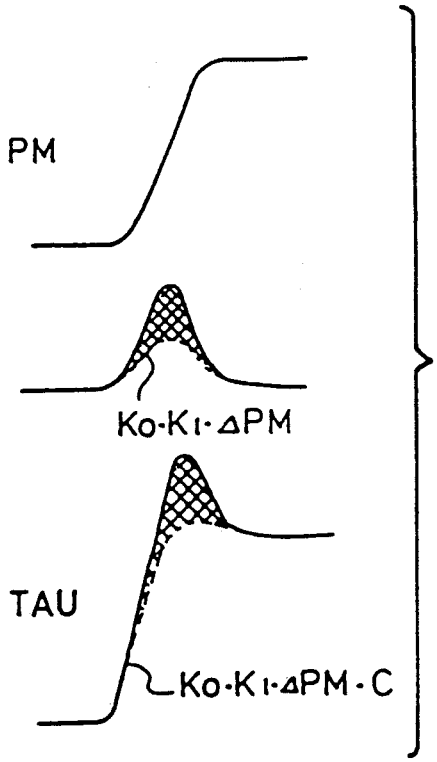

In step 132, since the basic fuel injection period Tp used for computing the fuel injection period TAU is corrected on the basis of the above-described formula (6) with the excessive correction prevented with the correction coefficient $K_0$, the delay due to the control delay can be prevented. As a result, the correction value corresponding to the actual amount of intake air can be obtained. Therefore, the change in the air-fuel ratio at the time of rapid change can be prevented. The change in the fuel injection period TAU at this time becomes as shown in FIG. 15 (B) so that the transient response at the rapid change can be sufficiently maintained and the overshooting can be reduced. FIG. 15 (A) illustrates the change in the fuel injection period according to the first embodiment.

In the case where the coefficient $K_1$ is changed in accordance with the engine speed as described above, it is necessary for the fuel to be increased more in the case where the engine is at a low temperature. That is, the engine cooling water temperature is at a low temperature than in the case where the engine cooling water temperature is at a high temperature since the amount of fuel adhered to the inner wall of the intake manifold becomes larger. Therefore, it may be arranged in such a manner that the coefficient $K_1$ is expressed by a function of the engine speed and the engine cooling water temperature, and the coefficient $K_1$ is enlarged in proportion to the rise in the engine speed, and the coefficient $K_1$ is reduced in accordance with the rise in the engine cooling water temperature. In addition, the coefficient $K_1$ is determined as function f (PMW) of the weighted mean PMN, and also the same may be determined as function f (NE, THW, PMW) of the engine speed NE, engine cooling water temperature THW and the weighted mean PMN.

In the first embodiment, although the increment TPACC is computed in accordance with the second term of the formula (6) from the change rate ΔPM of the weighted mean of the intake pressure so as to restrict the change rate ΔPM, the increment may be computed from the change rate ΔTP of the basic fuel injection period in accordance with the second term of the formula (5). In this case, the change rate ΔTP of the basic fuel injection period may be restricted.

In the second embodiment, although the increment TPACC is computed by multiplying the correction coefficient $K_0$ and the second term of the formula (6) from the change rate ΔPM of the weighted mean of the intake pressure and the correction coefficient $K_0$, it may be computed by multiplying the correction $K_0$ and the second term of the formula (5). Therefore, the increment TPACC may be computed from the change rate ΔPM of the basic fuel injection period and the correction coefficient $K_0$. In addition, although the correction coefficient $K_0$ is arranged to be reduced in inverse proportion to the absolute value of the change rate ΔPM of the weighted mean of the intake pressure, it may be arranged to be reduced in inverse proportion to the absolute value of the change rate ΔPM of the basic fuel injection period.

Figure 16:
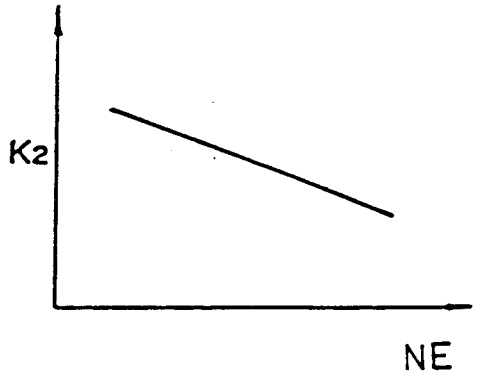
FIGS. 16 and 17 are diagrams which illustrate maps for coefficient $K_2$.
Figure 17:
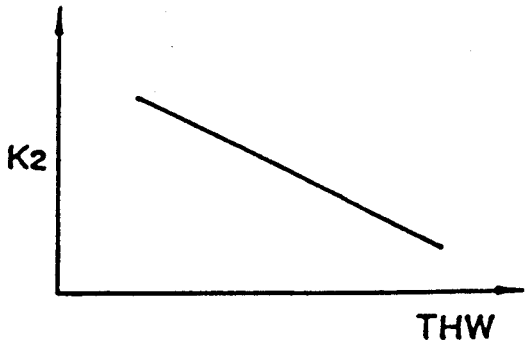

Furthermore, an arrangement may be employed in which the basic fuel injection period is arranged to be corrected by the following term (8).

$$K_2 \cdot DLPMIi \cdot C \tag{8}$$

where K2 represents a second coefficient and can be, as shown in FIGS. 16 and 17, changed in accordance with any of the engine speed, engine cooling water temperature and the intake pressure. The DLPMIi is an estimation of a damped value being the difference between the present weighted value expressed by the following formula (9) and the weighted value detected one period previously. It can be considered that if the engine speed NE is raised, the intake air velocity is also raised, and amount of fuel adhered to the inner wall of the intake manifold becomes reduced so that a major portion of the fuel can be supplied to the combustion chamber. To this end, the coefficient $K_2$ is arranged to be reduced in accordance with the rise in the engine speed. When the engine cooling water temperature is raised, the amount of evaporation of fuel adhered to the inner wall of the intake manifold becomes reduced. Therefore, the coefficient $K_2$ is arranged to be reduced in accordance with the rise in the engine cooling water temperature. In addition, when the intake pressure is raised, the amount of fuel evaporation becomes reduced and the amount of fuel adhered to the inner wall of the intake manifold becomes larger. Therefore, the coefficient $K_2$ can be determined as to be enlarged in proportion to the weighted mean of the intake pressure in the following formula (9), $$DLPMIi = \Delta PM + K_3 \cdot DLPMIi_{-1} \tag{9}$$

$K_3$ represents a positive damping coefficient and $DLPMIi_{-1}$ represents an estimation computed in the previous cycle. This dampling coefficient $K_3$ may employ a constant, and alternatively, may be determined, similarly to the coefficient $K_2$, on the basis of the engine speed NE, weighted mean PMN of the intake pressure, and the engine cooling water temperature THW. In the case where the coefficient $K_3$ is changed, the damping speed is lowered by enlarging the coefficient $K_3$ in the change state of the operation in which the amount of fuel adhered to the inner wall of the intake manifold increases, while the damping speed is raised by reducing the coefficient K3 in the change state of the operation in which the amount of fuel adhered to the inner wall of the intake manifold is decreased.

Assuming that the initial value of the estimation is 0, the difference ΔPM is changed as $\Delta PM_1$, $\Delta PM_2$, . . . , ΔPMi during one calculation in the formula (9), and the i-th DLPMIi can be expressed by the following formula (10).

$$\begin{aligned} DLPMIi = {} & \Delta PMi + K_3 \cdot \Delta PMi_{-1} + K_3^2 \cdot \\ & \Delta PMi_{-2} + \ldots + K_3^{i-2} \cdot \\ & \Delta PM_2 + K_3^{i-1} \cdot \Delta PM_1 \end{aligned} \tag{10}$$

Therefore, the estimation value is gradually enlarged from start of the ,acceleration, and it is arranged to be a certain value from after completion of the acceleration to the time the same comes close to 0 by the damping coefficient $K_3$.

Simultaneously carrying out the correction for estimating the basic fuel injection period corresponding to the actual amount of intake air and the correction shown in the term (8), the basic fuel injection period TP becomes as expressed by the following formula (11) or formula (12).

$$TP = TP_0 + K_1 \cdot \Delta PM \cdot C + K_2 \cdot DLPMIi \cdot C \quad (11)$$

$$TP = TP_0 + K_1 \cdot \Delta TP + K_2 \cdot DLTPIi \quad (12)$$

Furthermore, simultaneously carrying out the correction for estimating the basic fuel injection period corresponding to the actual amount of intake air, the correction expressed by the term (8), and the correction with the correction coefficient $K_0$, the basic fuel injection time TP becomes as shown in the following formula (13) or formula (14).

$$TP = TP_0 + K_0 \cdot K_1 \cdot \Delta PM \cdot C + K_2 \cdot DLPMIi \cdot C \quad (13)$$

$$TP = TP_0 + K_0 \cdot K_1 \Delta TP + K_2 \cdot DLTPIi \quad (14)$$

where DLTPIi in the formula (14) is the estimation of the damping value of the difference between the present basic fuel injection period expressed by the following formula (15) and the basic fuel injection period one cycle before.

$$DLTPIi = \Delta TP + K_3 \cdot DLTPI_{-1} \quad (15)$$

Putting the intial value of the estimation to 0 in the formula (15) and assuming that the difference $\Delta TP$ is changed during i times of calculations as $\Delta TP_1$, $\Delta TP_2$, . . . , $\Delta TPi$, the DLTPIi at the i-th time becomes the formula obtained by replacing $\Delta PM$ in formula (10) by $\Delta TP$.

The K1, K2, and K3 used in the formulas (11), (12), (13), and (14) may be determined on the basis of the engine speed, engine cooling water temperature or absolute intake air pressure in order to cover a wide range of changing states of operation. The coefficients which cannot change the demand of the fuel injection rate in the changing states of operation even if each of the parameters thereof are changed may be defined as constants.

Figure 18A:
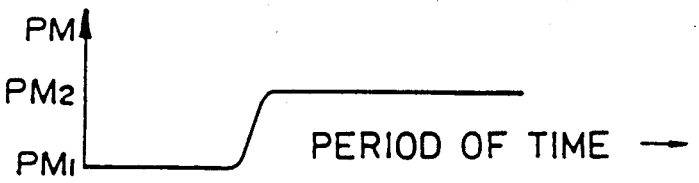
Figure 18B:
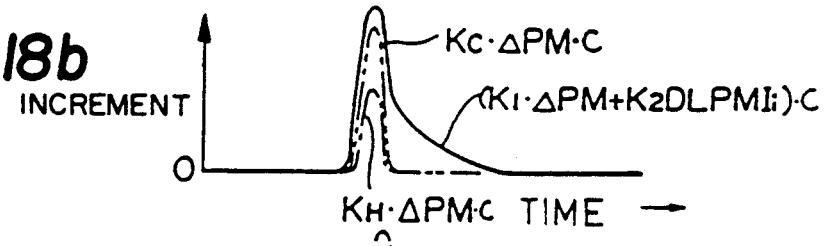
Figure 18C:
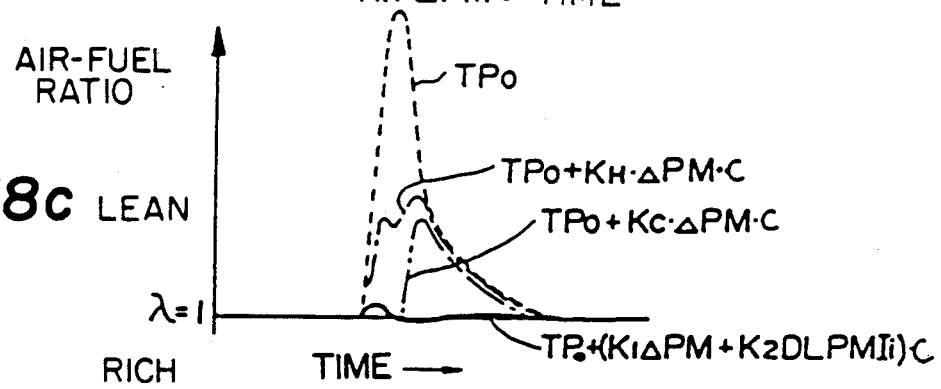

Experimental results of the changes in the acceleration increment and the air-fuel ratio when the basic fuel injection period is corrected as described above in the state where the engine is cooled will be described classifying the cases into a case where the present basic fuel injection period TP: is not corrected, a case where value KH corresponding to the engine warm period is used as the value of $K_1$ and a case where the value Kc (>KH) corresponding to the engine cool period is used as the value of $K_1$. In order to simplify the description, it is arranged that $K_0 = 1.0$. As shown in FIG. 18 (A), in the acceleration operation in which the intake pressure is changed from $PM_1$ to $PM_2$ when the engine is in the cooled state, if the fuel is injected on the basis of the present fuel injection period $TP_0$, the increment becomes 0 and the air-fuel ratio is changed as shown in FIG. 18 (C), causing the excessive lean spikes to be generated. As a result, the emission and the driveability can deteriorate. Although the lean spikes can be halved by correcting this basic fuel injection period $TP_0$ and injecting fuel on the basis of $TP_0 + KH \cdot \Delta PM \cdot C$, a case where the change of the air-fuel ratio has not been as yet reduced can occur. The reason for this can be considered to lie in that the change in the amount of fuel adhered to the inner wall of the manifold is too large when the temperature of the engine has been lowered. If the value of $K_1$ is further enlarged, value Kc which is suitable for the case where the engine is at a low temperature is used, and fuel is injected on the basis of $TP_0 + K_c \cdot \Delta PM \cdot C$, so that the lean spike at the initial acceleration can be, as shown in FIG. 18 (C), substantially overcome. However, the lean spikes can remain in the latter stage of the acceleration and the final state of the acceleration. The reason for this can be considered to lie in that the intake pressure becomes enlarged at the latter stage of the acceleration and the final stage of the acceleration, causing the amount of fuel evaporation to be reduced, and thereby causing the amount, of adhesion to the inner wall of the intake manifold to become enlarged.

Considering the above-described phenomenon, in the formulas (11), (12), (13), and (14), the present fuel injection period is corrected on the basis of a product of: the change rate expressed by the difference between the present basic fuel injection period and the basic fuel injection period computed one cycle before or the difference between the present weighted value and the weighted value detected one cycle before; and a first coefficient changed in accordance with the engine speed, and a product of the damping value of the change rate and the second coefficient. Since the estimation of this damping value maintains a certain value even after the acceleration is in the final stage or the acceleration has been completed, the lean spikes which can be generated in the final stage of the acceleration and after the acceleration has been completed when the basic fuel injection period is corrected by substituting $K_1$ as for $K_c$ can be prevented. As a result, the air-fuel ratio at the time of changing states of operation, for example, changing acceleration, can be made substantially constant as shown by a continuous line in FIG. 18 (C) where only the air-fuel ratio corresponding to the formulas (11) and (13) are illustrated.

Although the case where the fuel injection rate is controlled is described above, it can be embodied in a case where the ignition timing is controlled, and a case where the fuel injection rate and the ignition timing are simultaneously controlled.

The present, invention is effective in all of the phase advance controls in which the change rate $\Delta PM$ is used, that is, in cases where the following differential factors of higher order are used, the overshooting can be reduced and the excessive correction of the ignition timing attributable to the overshooting can be prevented by determining the ignition timing.

$$PM + K_4 \cdot \Delta PM$$
$$PM + K_4 \cdot \Delta PM - K \cdot \Delta\Delta PM$$
$$PM + K_4 \cdot \Delta PM - K_5 \cdot \Delta\Delta PM + K_6 \cdot \Delta\Delta\Delta PM$$

In this case, it is preferable that the $\Delta\Delta PM$ and $\Delta\Delta\Delta PM$ be restricted not to exceed a predetermined region.

In addition, in a case where the following differential factors of higher order are used, the effect of reducing the overshooting with $K_0$ can be obtained, and by determining the ignition timing, the excessive correction of the ignition timing or the like due to the overshooting can be prevented.

$$PM + K_0 \cdot K_4 \cdot \Delta PM$$
$$PM + K_0 \cdot K_4 \cdot \Delta PM + K_5 \cdot \Delta\Delta PM$$
$$PM + K_0 \cdot K_4 \cdot \Delta PM + K_5 \cdot \Delta\Delta PM + K_6 \cdot \Delta\Delta\Delta PM$$

In this case ΔΔPM and ΔΔΔPM may be corrected with the correction coefficient $K_0$.

What is claimed is:

1. A control apparatus for an internal combustion engine comprising:
   - a pressure sensor for detecting an intake pressure;
   - coefficient means for detecting a rotational speed of the engine and setting a K1 coefficient based thereon;
   - operating value determining means for determining an operating value based on an output of said pressure sensor;
   - change rate computing means for computing a change rate of said operating value;
   - change rate restricting means for restricting said change rate so that it does not exceed a predetermined value;
   - correction value means for computing a correction value based on said restricted change rate and said K1 coefficient and for correcting said control factor on the basis of said correction value; and
   - control means for controlling said engine on the basis of said control factor which has been corrected by said correction value means.

2. A control apparatus for an internal combustion engine according to claim 1, wherein said operating value determining means obtains said operating value by weighting a weighted mean which has been previously computed, and computing a present weighted mean from said weighted mean which has been previously computed and a present level of said signal transmitted from said pressure sensor.

3. A control apparatus for an internal combustion engine according to claim 1, wherein said predetermined value is a predetermined positive value.

4. A control apparatus for an internal combustion engine according to claim 1, wherein said predetermined value is a predetermined negative value.

5. A control apparatus for an internal combustion engine comprising:
   - a pressure sensor for detecting an intake pressure;
   - a rotational speed sensor for detecting an engine rotational speed;
   - weighting means for obtaining a weighted value by weighting a change in a signal from said pressure sensor;
   - means for computing a basic fuel injection period on the basis of said weighted value and said engine rotational speed;
   - means for computing a change rate of one of said weighted value or said basic fuel injection period;
   - means for restricting said change rate such that is does not exceed a predetermined value;
   - means for setting a coefficient on the basis of said rotational speed detected by said rotational speed sensor;
   - means for computing a correction value on the basis of both said change rate which has been restricted by said restriction means, and said coefficient;
   - means for computing a fuel injection period by correcting said basic fuel injection period with said correction value; and
   - means for controlling a fuel injection rate on the basis of said fuel injection period.

6. A control apparatus for an internal combustion engine according to claim 5, wherein said weighting means obtains said weighted value by weighting a weighted mean which has been previously computed, and computing a weighted mean with said weighted mean which has been previously computed and a present level of said signal transmitted from said pressure sensor.

7. A control apparatus for an internal combustion engine according to claim 5, wherein said restriction means restricts said change rate such that it does not exceed a predetermined value.

8. A control apparatus for an internal combustion engine according to claim 5, wherein said restriction means restricts said change rate so as not be become a value less than a predetermined negative value.

9. A control apparatus for an internal combustion engine according to claim 5, wherein said correction means computes said correction value with K1·ΔPM·C when said change rate of said weighted value is computed with said change rate computing means, while the same computes said correction value with K1·ΔTP when said change rate of said basic fuel injection period is computed with said change rate computing means,
   - where K1, ΔPM, C, and ΔTP are respectively defined as follows:
   - K1: said coefficient, wherein said coefficient is enlarged in proportion to the engine speed,
   - ΔPM: said change rate of said weighted value which has been restricted by said restriction means,
   - C: a coefficient for converting said intake pressure into said fuel injection period, and
   - ΔTP: said change rate of said basic fuel injection period which has been restricted by said restriction means.

10. A control apparatus for an internal combustion engine according to claim 9, wherein said coefficient K1 is enlarged in proportion to said engine speed, and is also reduced in inverse proportion to engine cooling water temperature.

11. A control apparatus for an internal combustion engine according to claim 5, wherein said correction means computes said correction value with $K_1 \cdot \Delta PM \cdot C + K_2 \cdot DLPMIi \cdot C$ when said change rate of said weighted value is computed with said change rate computing means, while the same computes said correction value with $K_1 \cdot \Delta TP + K_2 \cdot DLTPIi$ when said change rate of said basic fuel injection period is computed by said change rate computing means,
   - where $K_1$, ΔPM, C, ΔTP, $K_2$, DLPMIi, and DLTPIi are defined as follows:
   - $K_1$: a coefficient which is enlarged in proportion to said engine speed,
   - ΔPM: said change rate of said weighted value which has been restricted by said restriction means,
   - C: a coefficient for converting said intake pressure into said fuel injection period, ΔTP: said change rate of said basic injection period which has been restricted by said restriction means,
   - $K_2$: a coefficient which is reduced in inverse proportion to said engine speed, which is reduced in inverse proportion to engine cooling water temperature, or which is enlarged in proportion to said weighted value,
   - DLPMIi: an estimation of a damping value which has damped the difference between a present weighted value and a previous weighted value at a predetermined rate, and DLTPIi: an estimation of a damping value which has damped the difference between a present basic fuel injection period and a previous basic fuel injection period.

12. A control apparatus for an internal combustion engine according to claim 5, wherein said weighting means uses, for computing said weighted value, the output from said pressure sensor which has been processed by a filter having a time constant which can erase an engine pulsation component.

13. A control apparatus for an internal combustion engine comprising:

a pressure sensor for detecting an intake pressure;

a rotational speed sensor for detecting engine speed;

weighting means for obtaining a weighted value by weighting a change in a signal from said pressure sensor;

means for computing a basic fuel injection period on the basis of said weighted value and said engine speed;

means for computing a change rate of said weighted value or said basic fuel injection period;

first coefficient setting means for setting a first coefficient on the basis of said rotational speed detected by said rotational speed sensor;

second coefficient means for setting a second coefficient which is reduced in inverse proportion to an absolute value of said change rate;

means for computing a correction value on the basis of said change rate and said first and second coefficients;

means for computing a fuel injection period by correcting said basic fuel injection period with said correction value; and means for controlling fuel injection rate on the basis of said fuel injection period.

14. A control apparatus for an internal combustion engine according to claim 13, wherein said weighting means obtains said weighted value by weighting a weighted mean which has been previously computed, and computing a present weighted mean with said weighted mean which has been previously computed and a present level of said signal transmitted from said pressure sensor.

15. A control apparatus for an internal combustion engine according to claim 13, wherein said correction means computes said correction value with $K_0 \cdot K_1 \cdot \Delta PM \cdot C$ when said change rate of said weighted value is computed with said change rate computing means, while the same computes said correction value with $K_0 \cdot K_1 \cdot \Delta TP$ when said change rate of said basic fuel injection period is computed by said change rate computing means, where $K_0$, $K_1$, $\Delta PM$, C and $\Delta TP$ are defined as follows:

$K_0$: a correction coefficient which has been set by said coefficient setting means;

$K_1$: a coefficient which is enlarged in proportion to said engine speed, $\Delta PM$: said change rate of said weighted value, C: a coefficient for converting said intake pressure into said fuel injection period, and $\Delta TP$: said change rate of said basic injection period.

16. A control apparatus for an internal combustion engine according to claim 13, wherein said coefficient setting means sets said correction coefficient which is reduced in inverse proportion to the absolute value of said change rate in such a manner that said change rate of said correction coefficient is larger in a case where said change rate is a negative value than a case where said change rate is a positive value.

17. A control apparatus for an internal combustion engine according to claim 13, wherein said correction means computes said correction value with $K_0 \cdot K_1 \cdot \Delta PM \cdot C + K_2 \cdot DLPMIi \cdot C$ when said change rate of said weighted value is computed with said change rate computing means, while the same computes said correction value with $K_0 \cdot K_1 \cdot \Delta TP + K_2 \cdot DLTPIi$ when said change rate of said basic fuel injection period is computed by said change rate computing means, where $K_0$, $K_1$, $\Delta PM$, C, $\Delta TP$, $K_2$, DLPMIi, and DLTPIi are defined as follows:

$K_0$: a correction coefficient which has been set by said coefficient setting means, $K_1$: a coefficient which is enlarged in proportion to said engine speed, $\Delta PM$: said change rate of said weighted value, C: a coefficient for converting said intake pressure into said fuel injection period, $\Delta TP$: said change rate of said basic fuel injection period, $K_2$: a coefficient which is reduced inverse proportion to said engine speed, which is reduced in inverse proportion to said engine cooling water temperature, or which is enlarged in proportion to said weighted value, DLPMIi: an estimation of a damping value which has damped the difference between a present weighted value and a previous weighted value at a predetermined rate, and DLTPIi: an estimation of a damping value which has damped the difference between a present basic fuel injection period and previous basic fuel injection period.

18. A control apparatus for an internal combustion engine according to claim 16, wherein said coefficient $K_1$ is enlarged in proportion to a rise in said engine speed and is reduced in inverse proportion to a rise in said engine cooling water temperature.

19. A control apparatus for an internal combustion engine according to claim 13, wherein said weighting means uses, for computing said relaxation value, the output from said pressure sensor which has been processed by a filter having a time constant which can erase an engine pulsation component.

20. A control apparatus for an internal combustion engine comprising;

a pressure sensor for detecting an intake pressure;

a rotational speed sensor for detecting an engine rotational speed;

operating value computing means for computing a operating value based on the output of said pressure sensor;

control factor computing means for computing a control factor to control said internal combustion engine on the basis of said operating value;

change rate computing means for computing a change rate of said operating value;

first coefficient setting means for setting a first coefficient on the basis of said rotational speed detected by rotational speed sensor;

second coefficient setting means for setting a second coefficient which is reduced in inverse proportion to an absolute value of said change rate;

correction value computing means for computing a correction value on the basis of said change rate, said first coefficient, and said second coefficient;

control factor correcting means for correcting said control factor on the basis of said correction value; and controlling means for controlling said engine on the basis of said control factor which has been corrected by said correcting means.

21. A control apparatus for an internal combustion engine according to claim 20, wherein said operating value computing means obtains said operating value by averaging a weighted means which has been previously computed, and computing a present weighted mean from said weighted mean which has been previously computed and a present level of said signal transmitted from said pressure sensor.

22. A control apparatus for an internal combustion engine according to claim 20, wherein said coefficient means sets a correction coefficient which is reduced in inverse proportion to the absolute value of said change rate in such a manner that the change rate of said correction coefficient is larger when said change rate is a negative value than when said change rate is a positive value.

* * * * *